US011965715B2

(12) United States Patent
Cole et al.

(10) Patent No.: US 11,965,715 B2
(45) Date of Patent: Apr. 23, 2024

(54) LONG DISTANCE SHOOTING TOOL FOR TARGET IDENTIFICATION, COMMUNICATION, AND BALLISTIC DATA

(71) Applicant: The United States of America, as represented by the Secretary of the Navy, Crane, IN (US)

(72) Inventors: Aaron Boyd Cole, Bloomington, IN (US); John D. Rodriguez, San Diego, CA (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/977,299

(22) Filed: Oct. 31, 2022

(65) Prior Publication Data

US 2023/0160661 A1 May 25, 2023

Related U.S. Application Data

(60) Provisional application No. 63/273,231, filed on Oct. 29, 2021.

(51) Int. Cl.
*F41G 3/16* (2006.01)

(52) U.S. Cl.
CPC ..... *F41G 3/165* (2013.01)

(58) Field of Classification Search
CPC ... F41G 3/165; F41G 3/06; F41G 3/08; F41G 1/38; F41G 1/387; F41G 1/473
USPC ..... 235/417, 400
See application file for complete search history.

(56) References Cited

U.S. PATENT DOCUMENTS

2009/0205239 A1* 8/2009 Smith, III ..... F41G 1/38 42/122
2012/0097741 A1* 4/2012 Karcher ..... F41G 1/473 235/404
2014/0110482 A1* 4/2014 Bay ..... F41G 1/44 235/404
2015/0321094 A1* 11/2015 Wei ..... A63F 13/27 463/31
2020/0200509 A1* 6/2020 Tamir ..... G06V 20/00
2021/0109254 A1* 4/2021 Clermont ..... G01W 1/02

* cited by examiner

*Primary Examiner* — Edwyn Labaze
(74) *Attorney, Agent, or Firm* — Naval Surface Warfare Center, Crane Division; Patrick Law

(57) ABSTRACT

Provided is a tool for providing long distance shooters with the ability to receive information from others in the field to adjust their weapon system for the best advantage based on distance, location, and range. The tool may implemented as an application on a mobile device such as a smart phone, for example, making the tool light weight, space efficient, and portable for use in the field. The communication ability allows for tracking shooting partners as well as on-the-spot coordination. The tool further provides range markings, yard lines, and topographic data that allow the shooter to make decisions based on real time data. Shooters are therefore afforded a tool that is portable, easy to use, and flexible enough to use in high-pressure environments.

20 Claims, 7 Drawing Sheets

500

DA = 0 ft. 115 DTAC 3677 fps. Scope Ht 2.25 in. YARDS 29.9 inHg 59 F 0% RH Increase 0.1 mil for each 10 degrees of inclination over 30

| | Drop - Angle and Slant Distance | | | | | | | | | | | |
|---|---|---|---|---|---|---|---|---|---|---|---|---|
| ADX | 0 | 10 | 15 | 20 | 25 | 30 | 35 | 40 | 45 | 50 | 55 | 60 |
| ACI | 100 | 98 | 96 | 94 | 91 | 87 | 82 | 77 | 70 | 64 | 57 | 50 |
| 25 | 1.4 | 1.4 | 1.3 | 1.3 | 1.2 | 1.1 | 0.9 | 0.8 | 0.7 | 0.5 | 0.4 | 0.3 |
| 50 | 0.3 | 0.3 | 0.3 | 0.2 | 0.2 | 0.1 | 0.0 | 0.0 | -0.1 | -0.2 | -0.3 | -0.3 |
| 75 | 0.1 | 0.1 | 0.0 | 0.0 | -0.1 | -0.1 | -0.2 | -0.2 | -0.3 | -0.4 | -0.4 | -0.5 |
| 100 | 0.0 | 0.0 | -0.1 | -0.1 | -0.1 | -0.2 | -0.3 | -0.3 | -0.4 | -0.4 | -0.5 | -0.5 |
| 125 | 0.0 | 0.0 | 0.0 | -0.1 | -0.1 | -0.2 | -0.2 | -0.3 | -0.3 | -0.4 | -0.4 | -0.5 |
| 150 | 0.1 | 0.1 | 0.0 | 0.0 | -0.1 | -0.1 | -0.2 | -0.2 | -0.3 | -0.3 | -0.4 | -0.4 |
| 175 | 0.2 | 0.2 | 0.1 | 0.0 | 0.0 | -0.1 | -0.1 | -0.2 | -0.2 | -0.3 | -0.4 | -0.4 |
| 200 | 0.3 | 0.3 | 0.2 | 0.2 | 0.1 | 0.0 | 0.0 | -0.1 | -0.2 | -0.2 | -0.3 | -0.4 |
| 225 | 0.4 | 0.4 | 0.3 | 0.3 | 0.2 | 0.1 | 0.1 | 0.0 | -0.1 | -0.2 | -0.2 | -0.3 |
| 250 | 0.5 | 0.5 | 0.4 | 0.4 | 0.3 | 0.2 | 0.2 | 0.1 | 0.0 | -0.1 | -0.2 | -0.3 |
| 275 | 0.6 | 0.6 | 0.6 | 0.5 | 0.4 | 0.4 | 0.3 | 0.2 | 0.1 | 0.0 | -0.1 | -0.2 |
| 300 | 0.8 | 0.8 | 0.7 | 0.6 | 0.6 | 0.5 | 0.4 | 0.3 | 0.2 | 0.1 | 0.0 | -0.1 |
| 325 | 0.9 | 0.9 | 0.8 | 0.8 | 0.7 | 0.6 | 0.5 | 0.4 | 0.3 | 0.2 | 0.1 | 0.0 |
| 350 | 1.1 | 1.1 | 1.0 | 0.9 | 0.8 | 0.7 | 0.6 | 0.5 | 0.4 | 0.3 | 0.2 | 0.1 |
| 375 | 1.2 | 1.2 | 1.1 | 1.1 | 1.0 | 0.9 | 0.8 | 0.6 | 0.5 | 0.4 | 0.3 | 0.1 |
| 400 | 1.4 | 1.4 | 1.3 | 1.3 | 1.1 | 1.0 | 0.9 | 0.8 | 0.6 | 0.5 | 0.4 | 0.3 |
| 425 | 1.6 | 1.5 | 1.5 | 1.4 | 1.3 | 1.2 | 1.0 | 0.9 | 0.8 | 0.6 | 0.4 | 0.3 |
| 450 | 1.7 | 1.7 | 1.6 | 1.5 | 1.4 | 1.3 | 1.2 | 1.0 | 0.9 | 0.7 | 0.5 | 0.4 |
| 475 | 1.9 | 1.9 | 1.8 | 1.7 | 1.6 | 1.5 | 1.3 | 1.1 | 1.0 | 0.8 | 0.6 | 0.4 |
| 500 | 2.1 | 2.1 | 2.0 | 1.9 | 1.7 | 1.6 | 1.5 | 1.3 | 1.1 | 0.9 | 0.8 | 0.5 |
| 525 | 2.3 | 2.2 | 2.2 | 2.0 | 1.9 | 1.8 | 1.6 | 1.4 | 1.3 | 1.1 | 0.9 | 0.6 |
| 550 | 2.5 | 2.4 | 2.3 | 2.2 | 2.1 | 1.9 | 1.8 | 1.6 | 1.4 | 1.2 | 1.0 | 0.7 |
| 575 | 2.7 | 2.6 | 2.5 | 2.4 | 2.3 | 2.1 | 1.9 | 1.7 | 1.5 | 1.3 | 1.1 | 0.8 |
| 600 | 2.9 | 2.8 | 2.7 | 2.6 | 2.4 | 2.3 | 2.1 | 1.9 | 1.7 | 1.4 | 1.2 | 0.9 |
| 625 | 3.1 | 3.0 | 2.9 | 2.8 | 2.6 | 2.5 | 2.3 | 2.1 | 1.8 | 1.6 | 1.3 | 1.0 |
| 650 | 3.3 | 3.2 | 3.1 | 3.0 | 2.8 | 2.6 | 2.4 | 2.2 | 2.0 | 1.7 | 1.4 | 1.1 |
| 675 | 3.5 | 3.4 | 3.3 | 3.2 | 3.0 | 2.8 | 2.6 | 2.4 | 2.1 | 1.8 | 1.6 | 1.2 |

| | Wind (10 MPH) | | | | | Spin |
|---|---|---|---|---|---|---|
| Deg. | 0 | 30 | 45 | 60 | 75 | Drift |
| COS | 1 | 0.87 | 0.71 | 0.50 | 0.26 | (W) |
| 25 | 0.0 | 0.0 | 0.0 | 0.0 | 0.0 | 0.0 |
| 50 | 0.1 | 0.0 | 0.0 | 0.0 | 0.0 | 0.0 |
| 75 | 0.1 | 0.1 | 0.1 | 0.1 | 0.0 | 0.0 |
| 100 | 0.1 | 0.1 | 0.1 | 0.1 | 0.0 | 0.0 |
| 125 | 0.2 | 0.2 | 0.1 | 0.1 | 0.0 | 0.0 |
| 150 | 0.2 | 0.2 | 0.1 | 0.1 | 0.1 | 0.0 |
| 175 | 0.3 | 0.3 | 0.2 | 0.1 | 0.1 | 0.0 |
| 200 | 0.3 | 0.3 | 0.2 | 0.1 | 0.1 | 0.0 |
| 225 | 0.3 | 0.3 | 0.2 | 0.2 | 0.1 | 0.0 |
| 250 | 0.4 | 0.3 | 0.3 | 0.2 | 0.1 | 0.0 |
| 275 | 0.4 | 0.3 | 0.3 | 0.2 | 0.1 | 0.0 |
| 300 | 0.4 | 0.4 | 0.3 | 0.2 | 0.1 | 0.0 |
| 325 | 0.5 | 0.4 | 0.3 | 0.2 | 0.1 | 0.0 |
| 350 | 0.5 | 0.4 | 0.4 | 0.2 | 0.1 | 0.0 |
| 375 | 0.6 | 0.5 | 0.4 | 0.3 | 0.1 | 0.0 |
| 400 | 0.6 | 0.5 | 0.4 | 0.3 | 0.2 | 0.1 |
| 425 | 0.6 | 0.6 | 0.5 | 0.3 | 0.2 | 0.1 |
| 450 | 0.7 | 0.6 | 0.5 | 0.3 | 0.2 | 0.1 |
| 475 | 0.7 | 0.6 | 0.5 | 0.4 | 0.2 | 0.1 |
| 500 | 0.8 | 0.7 | 0.5 | 0.4 | 0.2 | 0.1 |
| 525 | 0.8 | 0.7 | 0.6 | 0.4 | 0.2 | 0.1 |
| 550 | 0.9 | 0.7 | 0.6 | 0.4 | 0.2 | 0.1 |
| 575 | 0.9 | 0.8 | 0.6 | 0.5 | 0.2 | 0.1 |
| 600 | 0.9 | 0.8 | 0.7 | 0.5 | 0.2 | 0.1 |
| 625 | 1.0 | 0.8 | 0.7 | 0.5 | 0.3 | 0.1 |
| 650 | 1.0 | 0.9 | 0.7 | 0.5 | 0.3 | 0.1 |
| 675 | 1.1 | 0.9 | 0.8 | 0.5 | 0.3 | 0.1 |

| | Mover | | |
|---|---|---|---|
| MPH | 1.0 | 2.5 | 3.0 |
| 25 | 1.0 | 1.1 | 1.6 |
| 50 | 1.0 | 1.2 | 1.4 |
| 75 | 1.0 | 1.2 | 1.5 |
| 100 | 1.0 | 1.2 | 1.5 |
| 125 | 1.0 | 1.2 | 1.5 |
| 150 | 1.0 | 1.3 | 1.6 |
| 175 | 1.0 | 1.3 | 1.5 |
| 200 | 1.0 | 1.3 | 1.6 |
| 225 | 1.0 | 1.3 | 1.5 |
| 250 | 1.0 | 1.3 | 1.5 |
| 275 | 1.0 | 1.3 | 1.6 |
| 300 | 1.0 | 1.3 | 1.6 |
| 325 | 1.0 | 1.3 | 1.6 |
| 350 | 1.1 | 1.3 | 1.6 |
| 375 | 1.1 | 1.3 | 1.6 |
| 400 | 1.1 | 1.3 | 1.6 |
| 425 | 1.1 | 1.3 | 1.6 |
| 450 | 1.1 | 1.4 | 1.6 |
| 475 | 1.1 | 1.4 | 1.6 |
| 500 | 1.1 | 1.4 | 1.7 |
| 525 | 1.1 | 1.4 | 1.7 |
| 550 | 1.1 | 1.4 | 1.7 |
| 575 | 1.1 | 1.4 | 1.7 |
| 600 | 1.1 | 1.4 | 1.7 |
| 625 | 1.2 | 1.4 | 1.7 |
| 650 | 1.2 | 1.5 | 1.7 |
| 675 | 1.2 | 1.5 | 1.8 |

FIG. 5

LONG DISTANCE SHOOTING TOOL FOR TARGET IDENTIFICATION, COMMUNICATION, AND BALLISTIC DATA

CROSS-REFERENCE TO RELATED APPLICATIONS

The present application claims the benefit of and priority to U.S. Provisional Patent Application Ser. No. 63/273,231, filed Oct. 29, 2021, and entitled "LONG DISTANCE SHOOTING TOOL FOR TARGET IDENTIFICATION, COMMUNICATION, AND BALLISTIC DATA," the disclosure of which is expressly incorporated by reference herein.

STATEMENT REGARDING FEDERALLY SPONSORED RESEARCH OR DEVELOPMENT

The present invention described herein was made in the performance of official duties by employees of the Department of the Navy and may be manufactured, used and licensed by or for the United States Government for any governmental purpose without payment of any royalties thereon. This invention (Navy Case 200512US02) is assigned to the United States Government and is available for licensing for commercial purposes. Licensing and technical inquiries may be directed to the Technology Transfer Office, Naval Surface Warfare Center Crane, email: Cran_CTO@navy.mil.

FIELD OF THE INVENTION

The present invention relates generally to firearm weapon systems and, more particularly, to a long distance shooting tool for providing target identification, communication, and ballistic data.

BACKGROUND

Three of the most important pieces of data for long distance shooting, hunting, competition, or law enforcement/military are target identification, communication, and ballistic data. Current methods for target identification include spotting targets visually and communicating with teammates via some other method such as signaling, radio communication, auditory communication, or other methods. These methods are not always optimal since the time between visually spotting each target, determining a shooting order, and proceeding enables the targets to move position. Additionally, communicating with teammates may reveal a shooter's position if visual or auditory methods are used such as hand signals, radio noise, or alert noise, as examples.

SUMMARY OF THE INVENTION

The present invention relates to a tool for providing long distance shooters with the ability to coordinate with others in the field to designate an order of shooting and to provide information on how to adjust their firearm for the best advantage based on distance, location, and range. The tool may be implemented by including an application on a smart phone, as one example, making it light weight, space efficient and portable for use in the field. The communication ability allows for tracking shooting partners as well as on-the-spot coordination. Range markings, yard lines, and topographic data are also provided that allow the shooter to make decisions based on real time data. Accordingly, the present invention provides shooters with more accurate information and better coordination with a tool that is also portable, easy to use, and flexible enough to use in high-pressure environments.

In a particular aspect, the present disclosure provides a long distance shooting tool comprising: a first user device for assisting a user performing long distance shooting with a firearm, wherein the first user device is communicatively coupled to one or more second user devices for receiving data from the second user devices concerning target information; the first user device including: a location module configured to receive geographic location information and determine the geographic location of the first user device; a display module configured to access map data and overlay at least the target information on the accessed map data for display to the user; and a ballistics module configured to calculate ballistics information for the firearm being used by the user and to communicate the ballistics information to the display module for selective access by user via the display module.

In another aspect, the present disclosure provides a non-transitory computer readable medium containing instructions, which when executed by a processing device, implement a long distance shooting method comprising: receiving data at a first user device for assisting a user performing long distance shooting with a weapon system from one or more second user devices, the data concerning at least target information; receiving a geographic location information and determining the geographic location of the first user device based on the received geographic information; accessing map data and overlaying at least the target information on the accessed map data based on, in part, the geographic location information for display to the user via a display in the first user device; and calculating ballistics information for the weapon system being used by the user and to displaying the ballistics information for selective access by the user via the display.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which:

FIG. 5 shows a view of a Dope/Density altitude card showing collected data throughout an entire ballistic curve according to aspects of the present disclosure.

DETAILED DESCRIPTION

The embodiments of the invention described herein are not intended to be exhaustive or to limit the invention to precise forms disclosed. Rather, the embodiments selected for description have been chosen to enable one skilled in the art to practice the invention.

The present disclosure provides for a tool and associated methodology to assist a shooter by providing data target identification, communication, and ballistic data to the shooter via a mobile or portable device according to aspects of the present disclosure. The aggregation of such data into a portable device such as a smart phone that can be used for this purpose is not available for users at this time. Use of a portable device such as a smart phone provides lightweight, space efficient, and portable solution that is easily adaptable for use in the field. The communication ability further allows for tracking friendly forces as well as on-the-spot coordination. Additionally, provision of range markings, yard lines, and topographic data allow a shooter to make decisions based on real time data.

Figure 1:
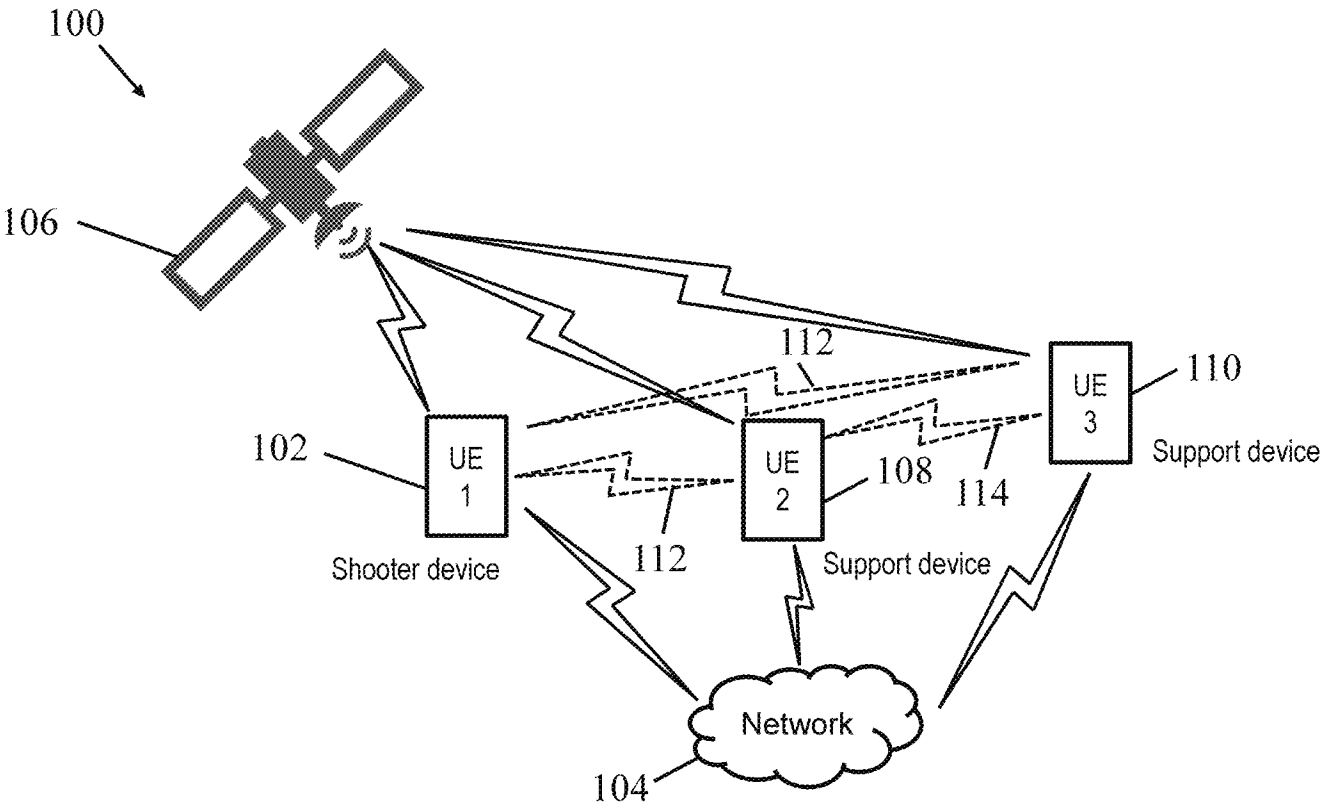
FIG. 1 illustrates an exemplary system diagram 100 of a long distance shooting tool or system that provides target identification, communication, and ballistic data to a shooter according to aspects of the present disclosure.

FIG. 1 illustrates an exemplary system diagram 100 of a long distance shooting tool or system that provides target identification, communication, and ballistic data to a shooter according to aspects of the present disclosure. As shown, the system may include a first user equipment 102 that is associated with a shooter using the system. As will be explained in further detail below, the first user equipment 102 provides the shooter with, among other things, visual information concerning target identification, target ranges, mapping, location, ballistic data, etc. that may be displayed on the equipment 102. In some aspects, the user equipment 102 may be implemented with a smart phone or other mobile device, and more specifically through an application running on a smart phone in some examples. The equipment 102 is communicatively coupled with a terrestrial network 104, such as a wireless local area network (WLAN) or a wireless wide area network (WWAN) as example, or some other suitable communication network. The equipment 102 may also be communicatively coupled to a satellite network (illustrated by satellite 106 as an example) for location services (e.g., global positioning system (GPS)), as well as for data communication in some aspects.

The system diagram 100 further illustrates one or more additional support devices (e.g., 108 and 110) that are communicatively coupled to the shooter device 102 for providing targeting information (as well as other communication messages/information) to the shooter device 102, as well as other information such as location information of the other users, from the other users of the system 100. Each of the one or more support devices 108, 110 may be coupled to the satellite network (e.g., 106) for GPS location services, as well as to the network 104 for providing, among other things, targeting information. Alternatively or in addition to, each of the support devices may be coupled using peer-to-peer (P2P) communications (or equivalents) as illustrated by signals 112. Each of the support devices 108 and 110 may communicate directly with the shooter device 102 using P2P, or may communicate via relaying or concatenation through another support device as exemplified by signaling 114 (i.e., signaling from support device 110 to shooter device 102 via support device 108). Of further note, the devices 102, 108, and 110 may be equipped with encryption capabilities/algorithms in order to encrypt data being transmitted there between.

Figure 2:
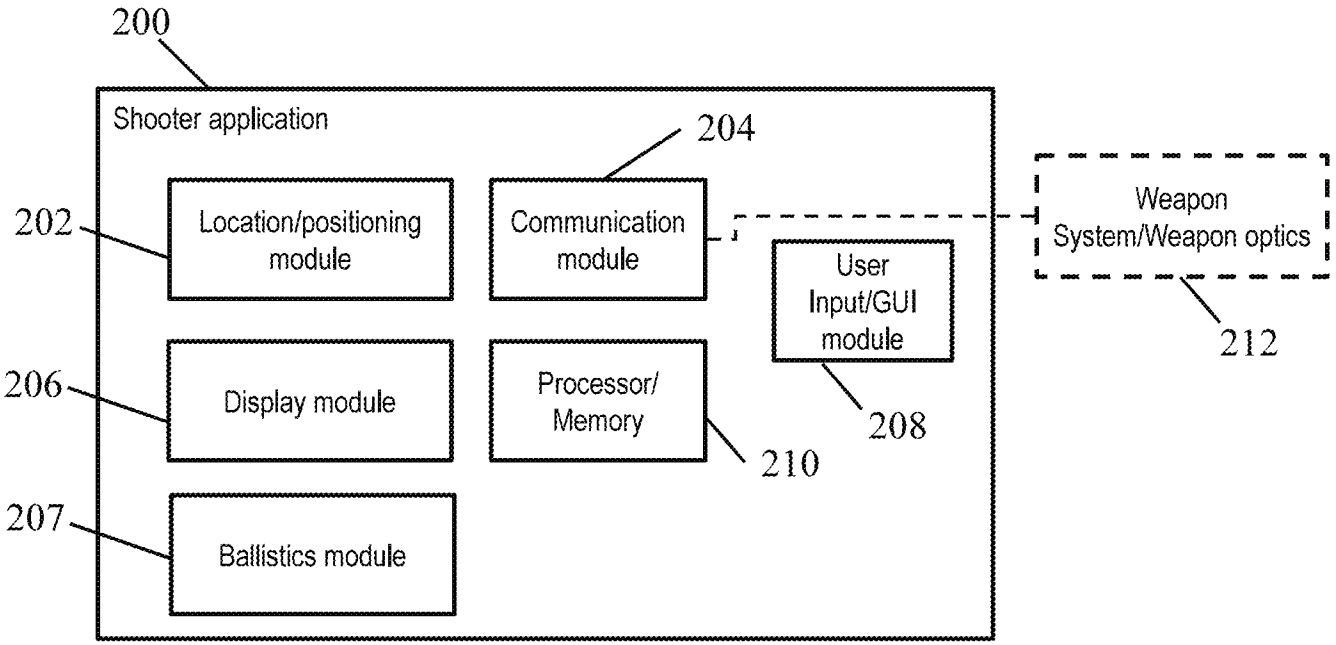
FIG. 2 illustrates an exemplary block diagram of functions of the shooting tool according to aspects of the present disclosure.

FIG. 2 illustrates an exemplary block diagram of modules for a shooter application 200, which may be executed or run by the shooter device 102 (also termed "a first user device"), as an example. The application 200 includes a location/positioning module 202, which is used to determine the location of the shooter device in geographic space and also to determine positioning of targets and range distances to be displayed to the shooter, which may be based on targeting information received from the one or more support devices (e.g., 108, 110 and also termed "second user devices"). Further, application 200 includes a communication module 204, which may implement any of a number of modes of wireless communication including one or more of cellular, Bluetooth, near field communication (NFC), P2P, optical, satellite, and IEEE 802.11 Wi-Fi communication. The communication module 204 may receive targeting/positioning information from one or more of the support devices (e.g., 108, 110) via one or more of the modes of wireless communication. Additionally, the communication module 204 may be configured to directly communicate with other external devices such as a ballistics calculator (e.g., a Kestrel ballistics solver or meter).

Figure 3:
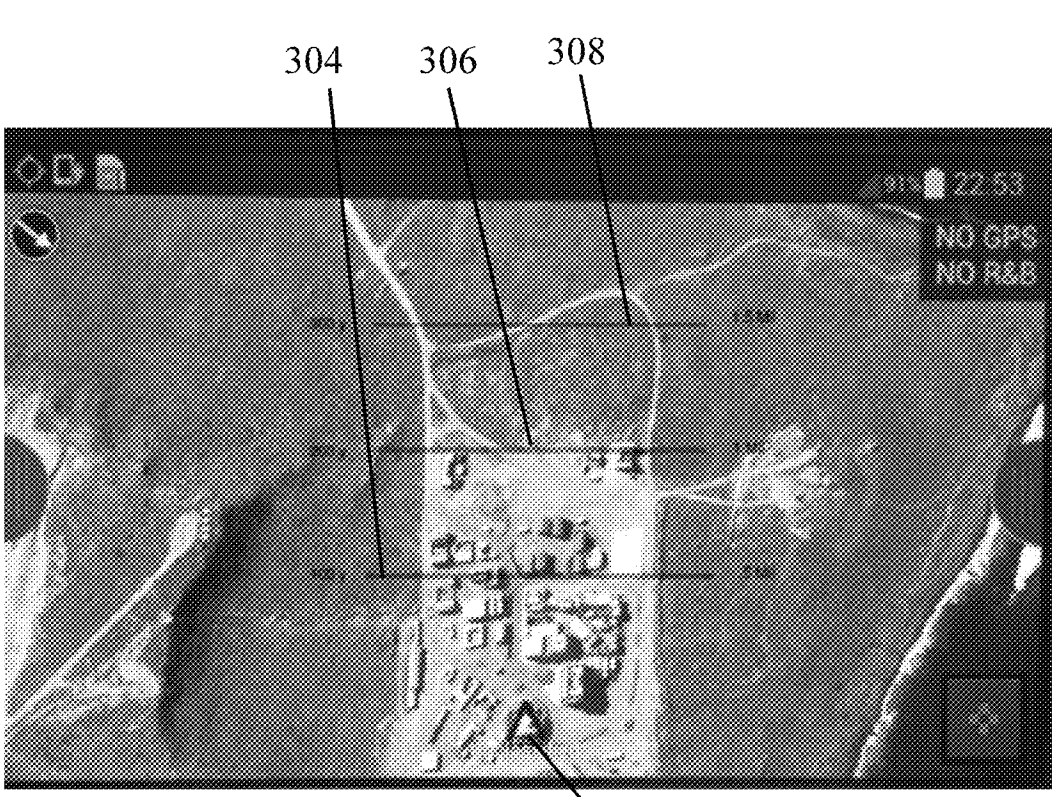
FIG. 3 illustrates an example of an overhead map displayed by the shooting tool to a user include distances in Mil/MOA from a current position of the user according to aspects of the present disclosure.

Shooter application 200 also includes a display module 206, which is used to display, among other things, map images and target information overlaid on the map images, which will be discussed in more detail with regard to FIGS. 3 and 4. The display module 206 may be configured to load internally stored map data and/or receive map data from wireless communications in order to determine the map data and location of the user device 102, and also to then accurately overlay the target information on the map images. Shooter application 200 also includes a ballistics module 207 configured to calculate ballistics information for the weapon system being used by the user and to communicate the ballistics information to the display module 206 for selective access by the user via the display module 206. Furthermore, the communication module 204 is configured to communicatively couple to an external ballistics meter or calculator such as discussed above to receive ballistics calculation data from the external ballistics meter or calculator for use by the ballistics module 207. Additionally, the display module 206 may interface with (or include in some examples) a user input/graphical user interface (GUI) module 208. The input module 208 may receive user input for one or more of selecting different imaging/targeting to be displayed by the display module 206, receive user input selections for implementing various aspects of the shooter application, and/or receive communications inputs from the user to be sent to the network, other users, or support devices.

Of further note, the shooter application 200 may be implemented on one or more processors coupled with one or more memory/database devices as illustrated by block 210. Here, the one or more processors may include one or more specialized processors or ASICS configured for implementing one or more of the various modules 202, 204, 206, 207 or 208 according to some aspects. Additionally, the one or more memory devices and/or databases may comprise a computer-readable medium or store computer-readable instructions that, when implemented by the one or more processors, effectuate the various modules or functions of the shooter tool (e.g., application 200). Furthermore, the one or more memory devices or databases may store one more map databases, weapon information, ballistics information, etc., that are used by the shooter tool (e.g., application 200) to display mapping information, and calculate and display ballistics information to the user.

In yet another alternative, the shooter application 200 (and/or device running the shooter application) may communicatively couple (wireless or wired) with a weapon system and/or weapon system optics (e.g., rifle sight) 212 to communicate some or all of the information determined by the application 200. In this aspect, the application may afford providing information to a user that is displayed in the weapon system optics.

In aspects, the present shooting tool or application (e.g., 200) provides a user with various information including displayed distance lines (e.g., yard lines) that can be overlaid on map data. As one example, FIG. 3 shows an exemplary display 300 that may be displayed to a user such as with display module 206. In this particular example, an overhead view of a map is shown with distances in yards and/or in milliradians/minutes of angle (Mil/MoA) from a current position of the user (i.e., user location 302). In this particular case shown in FIG. 3, yard lines 304, 306, 308 overlaying the map data are relative to the position of the user 302. The yard lines follow the user in the same way range rings work, by constantly tracking to the user's position and heading. The user is provided with the ability to choose desired color, weight and or opacity setting of yard lines. The user also includes the ability to choose the number, type, and amount of yard lines that are displayed. Yard lines preferably display Mil/MOA hold as well as distance without cluttering the image.

These distance lines may be configured to constantly track to a user's position and heading. Additionally, the display of the distance lines (also referred to hereinafter as "yard lines") may further be customizable by a user, allowing the user to choose desired colors, weights, and/or opacity as a few examples. Furthermore, the application provides a user with the ability to choose the amount or number of distance lines being displayed. Still further, users may further select between distance lines and range rings (not shown). User selectable, configurable, and reconfigurable range lines (yard lines for US customary units).

In yet other aspects, the application (e.g., 200) may provide user configurable yard lines with an auto calculated Mil/MoA verses the range. Additionally, the user customizable yard lines may be expressed in absolute line of sight range using an elevation of a user and a target or expressed in a relative 2D projection ground sample distance. In still further aspects, the yard lines are tracked to a shooter position and heading. The user may also break yard lines from a position heading and set the heading as desired.

In particular aspects, the ability for a user to be able to select color, weight, font size, and or opacity for each yard line may be performed either on screen (e.g., via a GUI) or via a pull out tab. Additionally, the application may be configured to display both the yard lines with range and Mil/MoA as illustrated in FIG. 3. Moreover, the yard lines can be quickly swiped away and previously configured yard lines can swiped back in. In still other aspects, the yard line ranges can be reconfigured through touch (e.g., a GUI) or through pen interface commands. In yet other aspects, specific yard line ranges can be numerically specified in a pull out tab via onscreen keyboard. Additionally, the application may be configured with an interface to quickly pre load mission specific configurations and settings.

Figure 4:
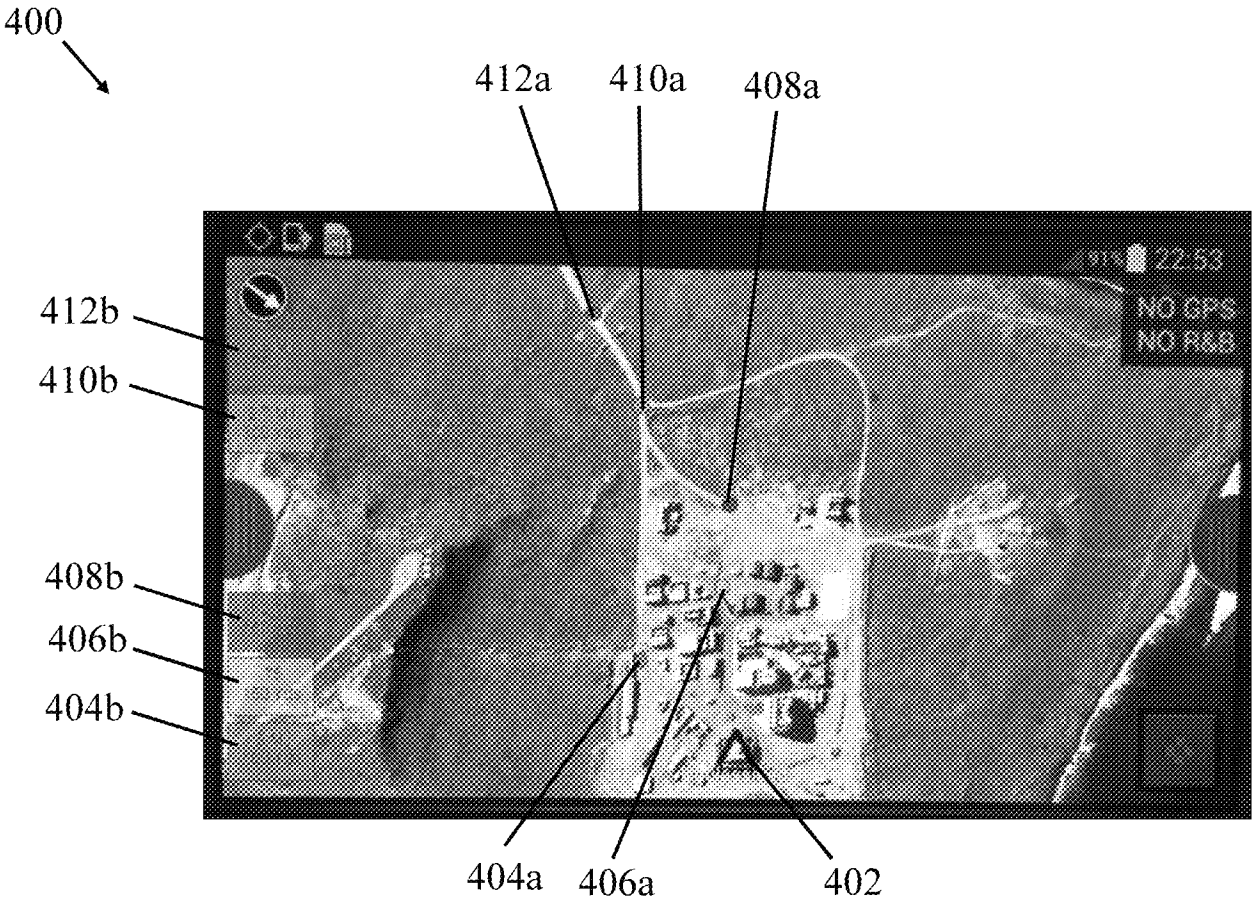
FIG. 4 illustrates an example of an overhead map displayed by the shooting tool to a user include distances in Mil/MOA from a current position of the user according to aspects of the present disclosure.

FIG. 4 illustrates another exemplary display 400 that may be displayed to a user such as with display module 206 according to other aspects of the present disclosure. In this view 400, color coded targeting and corresponding color coded range and Mil/MoA data information are shown to a user. In particular, the user location 402 is part of data overlaid on map data and various color coded target reference points (TRPs) are also overlaid as shown at 404*a*, 406*a*, 408*a*, 410*a*, and 412*a*. At another portion of the screen, additional corresponding range and Mil/MoA data is displayed in color coded boxes as may be seen by boxes 404*b*, 406*b*, 408*b*, 410*b*, and 412*b*, which respectively correspond to and provide information concerning targets 404*a*, 406*a*, 408*a*, 410*a*, and 412*a*. In this manner, the application is configured to allow the user to quickly mark desired TRPs in an easy, quickly referenced, and non-busy manner using colors, although the disclosure is not necessarily limited to such. In other embodiments, the display of the TRP information may be displayed on a side of a display screen as shown in FIG. 4 or, alternatively in a pull out tab or other similar display functionality.

FIG. 5 illustrates another exemplary display 500 that may be displayed to a user such as with display module 206 according to other aspects of the present disclosure. In particular, display 500 is a view of a particular Dope/Density altitude card showing collected data throughout the entire ballistic curve (and the data therein is merely exemplary for a particular location/weapon, etc.). The Dope/Density altitude card provides the user the ability use and/or view all the collected data throughout the entire ballistic curve. The Density altitude can be easily manipulated in order to display corrected holds. Angle manipulation also provides a good function for viewing holds to targets at a given angle. In aspects, the application 200 may display the Dope/Density altitude card either on a currently displayed screen itself or on a pull out tab. Further, the Ability for the shooter to make necessary changes if desired. Moreover, the application 200 is configured to afford the user the ability to pick a specific Dope/Density altitude card to use (e.g., a portion of the Dope/Density altitude card), thereby minimizing the information displayed to the user on the screen.

In still further aspects, the application may be configured to allow the user to make necessary changes if desired on a user reconfigurable pull out tab. In an example, a customizable pull out tab will initially enable a user to view all collected and calculated data throughout the ballistics curve.

Further features that may provided by application are configurability of the Dope/Density altitude card. In one example, the Dope/Density altitude card is configured to be easily manipulated in order to display corrected holds. Additionally, a user is afforded the ability to display multiple corrected holds. Furthermore, a user is afforded the ability to adjust shot angles of the corrected holds. Still further, multiple holds are configurable to allow for angle manipulation to let the user view a variety of corrected holds and to then select between them.

Figure 6A:
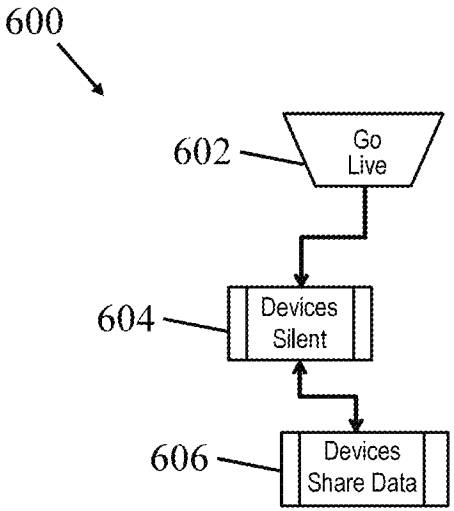
FIG. 6A illustrates a flow/state diagram of a methodology for implementing a shooter tool/application, such as those disclosed in FIGS. 1-5 according to aspects of the present disclosure.

FIG. 6A illustrates a flow/state diagram of a methodology for implementing a shooter tool/application, such as those disclosed in FIGS. 1-5. As illustrated, after the system or tool (e.g., tool 100) goes live at 602, a first state may be that the system is quiet wherein the devices (e.g., 102, 108, 110) do not share information and are silent as shown at 604. The next state then is that the devices share data at 606, such as was described earlier in connection with FIG. 1. In aspects, the processes at 606 may include the shooter or user device (e.g., 102) receiving data from one or more of the support devices (e.g., 108, 110) via various means such as wireless networks, Wi-Fi, optical, etc. This data is used to determine targeting information to be displayed such as was illustrated in FIGS. 3 and 4, as examples.

Figure 6B:
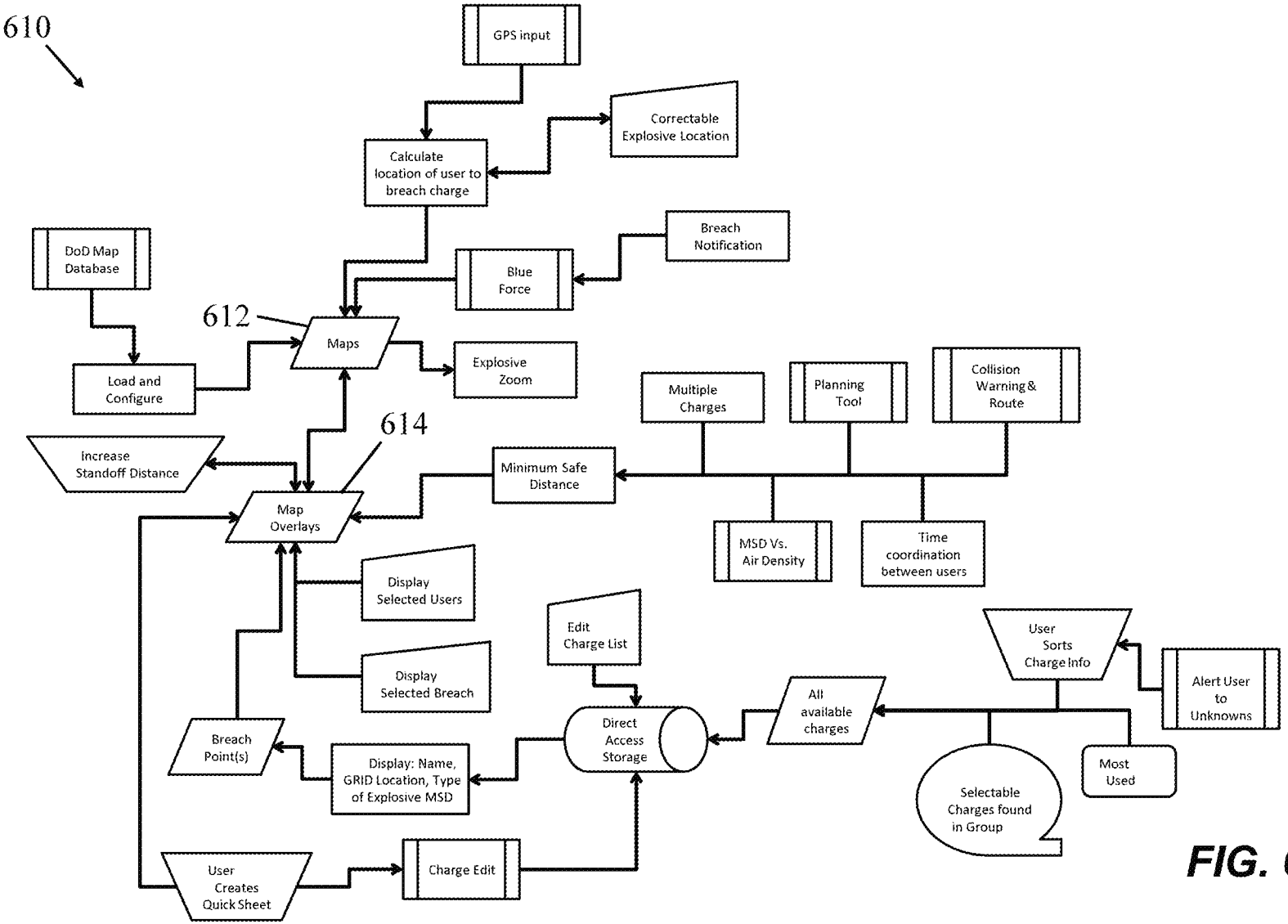
FIG. 6B illustrates an exemplary flow chart of the operation of the disclosed shooting application according to aspects of the present disclosure.

FIG. 6B, illustrates an exemplary flow chart of an overall operation 610 of the disclosed shooting application according to aspects of the present disclosure. A first part of the process of operation 610 includes gathering/loading/processing map data as shown at 612. This includes downloading of map database information as well as loading position information such as GPS. Another portion of operation 610 includes overlaying data onto the map data determined at 612, the overlaying operation shown at 614. This operation includes receiving a multitude of input data including, but not limited to, data concerning ballistics data, historical stored data, weapon system information, data from the support user devices, etc. The map overlays process in 614 is used, in part, to display information to a user as was illustrated by FIGS. 3-5, as examples.

In aspects, the present methods may be implemented by an apparatus that includes a computer, microcontroller, microprocessor, or specialized processor that executes computer-readable code stored on a tangible computer-readable medium. In a particular example, application 200 includes or at least is executed by at least one processing system including one or more processors 210 responsible for processing, including the execution of computer executable code or software stored on a computer-readable medium also shown at 210. Software shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise. The software, when executed by the processor 210, causes the processing system to perform the various functions described above for any particular apparatus. The computer-readable medium 210 may also be used for storing data that is manipulated by the processor 210 when executing software.

In further aspects, the computer-readable medium 210 may be a non-transitory computer-readable medium. A non-transitory computer-readable medium includes, by way of example, a magnetic storage device (e.g., hard disk, floppy disk, magnetic strip), an optical disk (e.g., a compact disc (CD) or a digital versatile disc (DVD)), a smart card, a flash memory device (e.g., a card, a stick, or a key drive), a random access memory (RAM), a read only memory (ROM), a programmable ROM (PROM), an erasable PROM (EPROM), an electrically erasable PROM (EEPROM), a register, a removable disk, and any other suitable medium for storing software and/or instructions that may be accessed and read by a computer. The computer-readable medium 210 may reside in the shooting application or system 200, external to the system 200, or distributed across multiple entities including the system 200. The computer-readable medium 210 may be embodied in a computer program product. By way of example, a computer program product may include a computer-readable medium in packaging materials. Those skilled in the art will recognize how best to implement the described functionality presented throughout this disclosure depending on the particular application and the overall design constraints imposed on the overall system.

Although the invention has been described in detail with reference to certain preferred embodiments, variations and modifications exist within the spirit and scope of the invention as described and defined in the following claims.

The invention claimed is:

1. A long distance shooting tool comprising:

a first user device for assisting a user performing long distance shooting with a weapon system, wherein the first user device is communicatively coupled to one or more second user devices via at least one wireless network for receiving data including target information about at least one target from one or more second users via the second user devices;

the first user device including:

a location module configured to receive geographic location information from at least one of a terrestrial network and a satellite network and determine the geographic location of the first user device;

a display module configured to access map data and overlay the target information on the accessed map data based on the determined geographic location information and the target information received from the one or more second user devices for display to the user; and a ballistics module configured to calculate ballistics information for the weapon system being used by the user and to communicate the ballistics information to the display module for selective access by the user via the display module.

2. The long distance shooting tool as defined in claim 1, further comprising:

a communication module configured to access the at least one wireless network for receiving one or more of the target information and communication messages from the one or more second user devices.

3. The long distance shooting tool as defined in claim 2, wherein the communication module is configured to communicatively couple to an external ballistics meter or calculator to receive ballistics calculation data from the external ballistics meter or calculator for use by at least the ballistics module.

4. The long distance shooting tool as defined in claim 2, wherein the communication module is configured to communicatively couple to the weapon system for providing one or more of targeting or ballistics data to the weapon system.

5. The long distance shooting tool as defined in claim 1, wherein the display module is further configured to be configurable based on inputs from a user input module in the first user device.

6. The long distance shooting tool as defined in claim 5, wherein the display module is configurable for displaying one or more of one or more target distance lines for one or more targets overlaid on map data, color coding of a plurality of target reference points (TRPs) overlaid on map data, and displaying Dope/Density altitude card information.

7. The long distance shooting tool as defined in claim 6, wherein the display module is further configurable for displaying color coded range and Mil/MoA data corresponding to correlative color coded TRPs of the plurality of TRPs.

8. The long distance shooting tool as defined in claim 1, wherein geographic location information includes global positioning system (GPS) information.

9. The long distance shooting tool as defined in claim 1, wherein the first user device and the one or more second user devices comprise a wireless user equipment (UE).

10. The long distance shooting tool as defined in claim 9, wherein the wireless user equipment comprises a smart phone.

11. A non-transitory computer readable medium containing instructions, which when executed by a processing device, implement a long distance shooting method comprising:

receiving data at a first user device for assisting a user performing long distance shooting with a weapon system from one or more second user devices via at least one wireless network, the data including at least target information about one or more targets from one or more second users via the one or more second user devices;

receiving geographic location information from at least one of a terrestrial network and a satellite network and determining the geographic location of the first user device based on the received geographic location information;

accessing map data and overlaying the target information on the accessed map data based on, in part, the received geographic location information and the target information received from the one or more second user devices for display to the user via a display in the first user device; and calculating ballistics information for the weapon system being used by the user; and displaying the ballistics information for selective access by the user via the display.

12. The non-transitory computer readable medium of claim 11 further containing instructions, which when executed by the processing device, implement the long distance shooting method including:

accessing the at least one wireless network for receiving one or more of the target information and communication messages from the one or more second user devices.

13. The non-transitory computer readable medium of claim 12 further containing instructions, which when executed by the processing device, implement the long distance shooting method including:

communicatively coupling to an external ballistics meter or calculator to receive ballistics calculation data from the external ballistics meter or calculator for use by at least the ballistics module.

14. The non-transitory computer readable medium of claim 11 further containing instructions, which when executed by a processing device, implement the long distance shooting method including:

configuring the display to be configurable based on inputs from a user input module in the first user device.

15. The non-transitory computer readable medium of claim 14 further containing instructions, which when executed by a processing device, implement the long distance shooting method including:

displaying one or more of one or more target distance lines for one or more targets overlaid on map data, color coding of a plurality of target reference points (TRPs) overlaid on map data, and displaying Dope/Density altitude card information.

16. The non-transitory computer readable medium of claim 14 further containing instructions, which when executed by a processing device, implement the long distance shooting method including:

displaying color coded range and Mil/MoA data corresponding to correlative color coded TRPs of the plurality of TRPs.

17. The non-transitory computer readable medium of claim 11 further containing instructions, which when executed by a processing device, implement the long distance shooting method including:

communicatively coupling the first user device to the weapon system for providing one or more of targeting or ballistics data to the weapon system.

18. The non-transitory computer readable medium of claim 11 further containing instructions, which when executed by a processing device, implement the long distance shooting method including:

the geographic location information including global positioning system (GPS) information.

19. The non-transitory computer readable medium of claim 11, wherein the first user device and the one or more second user devices comprise a wireless user equipment (UE).

20. The non-transitory computer readable medium of claim 19, wherein the wireless user equipment comprises a smart phone.

* * * * *